US006710684B2

(12) United States Patent
Mikkonen

(10) Patent No.: US 6,710,684 B2
(45) Date of Patent: Mar. 23, 2004

(54) COAXIAL RESONATOR STRUCTURE AND FILTER

(75) Inventor: Esa Mikkonen, Oulu (FI)

(73) Assignee: Filtronic LK Oy, Kempele (FI)

( * ) Notice: Subject to any disclaimer, the term of this patent is extended or adjusted under 35 U.S.C. 154(b) by 0 days.

(21) Appl. No.: 09/902,852

(22) Filed: Jul. 10, 2001

(65) Prior Publication Data

US 2002/0005768 A1 Jan. 17, 2002

(30) Foreign Application Priority Data

Jul. 17, 2000 (FI) ..... 20001676

(51) Int. Cl.[7] ..... H01P 1/20; H01P 7/04
(52) U.S. Cl. ..... 333/203; 333/222
(58) Field of Search ..... 333/202–203, 333/206, 219, 222

(56) References Cited

U.S. PATENT DOCUMENTS

| | | | | |
|---|---|---|---|---|
| 4,398,164 A | | 8/1983 | Nishikawa et al. | 333/222 |
| 4,422,236 A | | 12/1983 | Ware, Jr. et al. | 29/876 |
| 4,507,631 A | | 3/1985 | Louet et al. | 333/222 |
| 4,706,051 A | | 11/1987 | Dieleman et al. | 333/212 |
| 6,114,928 A | | 9/2000 | Smith | 333/202 |
| 6,335,668 B1 | * | 1/2002 | Henningsson et al. | 333/202 |

FOREIGN PATENT DOCUMENTS

| | | | |
|---|---|---|---|
| DE | 1 452 508 | 4/1969 | B21C/23/03 |
| DE | 26 07 334 | 8/1977 | B21K/25/00 |
| DE | 26 38 570 A1 | 2/1978 | B21K/25/00 |
| EP | 0 126 930 | 12/1984 | B21K/25/00 |
| WO | WO 97/21506 | 6/1997 | B21K/25/00 |

* cited by examiner

*Primary Examiner*—James H. Cho
(74) *Attorney, Agent, or Firm*—Darby & Darby

(57) ABSTRACT

The invention relates to a method for attaching an additional object to an object made by the process of extruding, especially a resonator body, and to the structure resulting from the application of the method. A recess is made in the pushing part (ES) of an extrusion machine, which recess is shaped like a portion of the surface of the additional object. The additional object (320), such as a portion of the inner conductor of a resonator, is inserted prior to extrusion in the said recess so that the said portion of the surface of the additional object rests tightly against the surface of the recess and the rest of the surface of the additional object remains free. In the extrusion stage, the pushing part with the additional object is pressed (F) against a bloom of a resonator body whereby the material (31*c*) of the bloom is pressed tight against the free surface of the additional object. When the pushing part is retracted the additional object remains attached to the body element thus formed. According to the invention, in conjunction with the manufacturing of the body element of the structure being manufactured, parts may be added to the body element without separate manufacturing steps, and the resulting bond is strong and uniform. Furthermore, in a filter manufactured according to the invention the inner conductors of the different resonators may be manufactured in different lengths.

1 Claim, 4 Drawing Sheets

Figure 1:
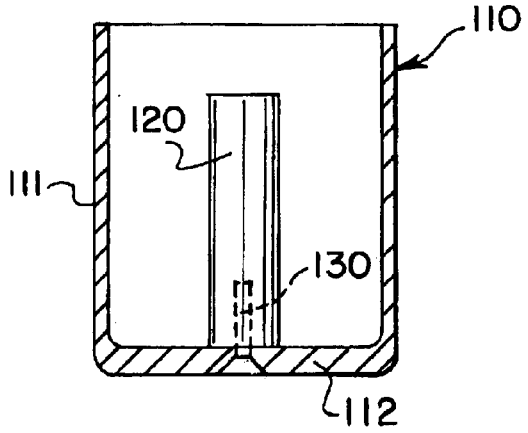
FIG. 1 PRIOR ART
Figure 2:
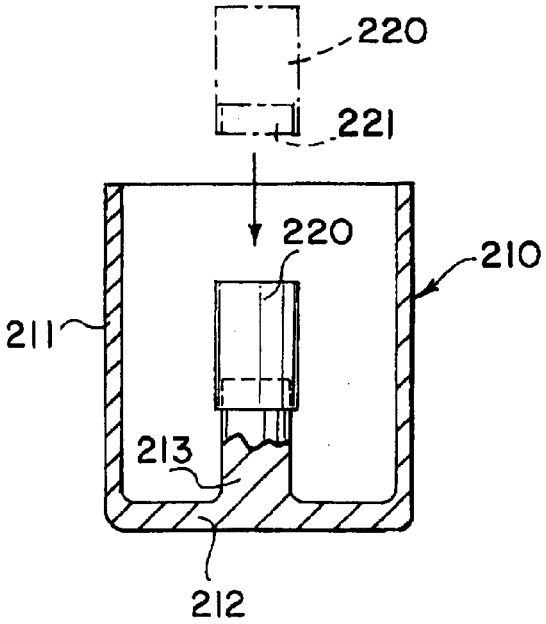
FIG. 2 PRIOR ART

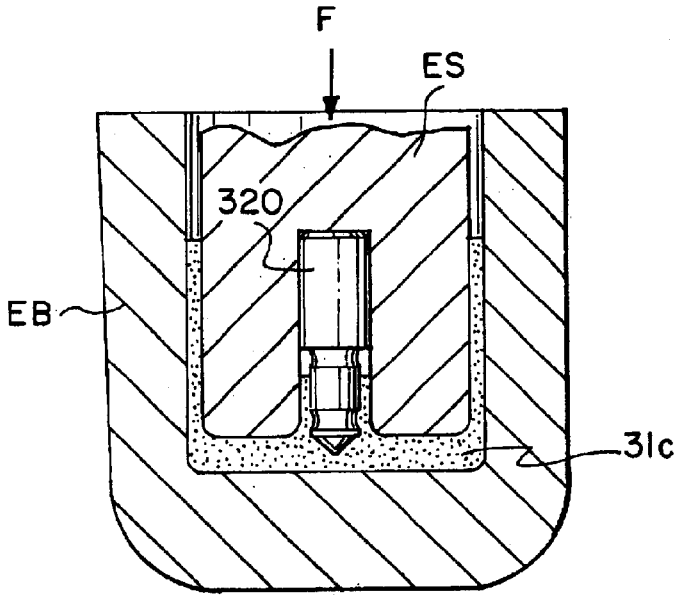
FIG. 3c
FIG. 3d-1
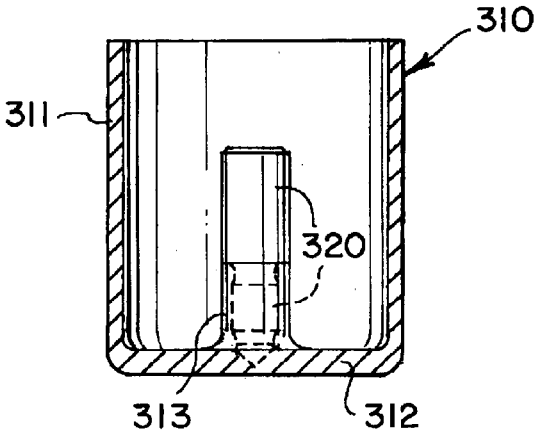
FIG. 3d-2
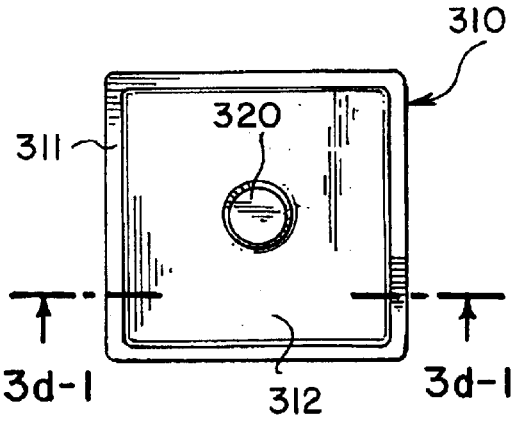
FIG. 4a
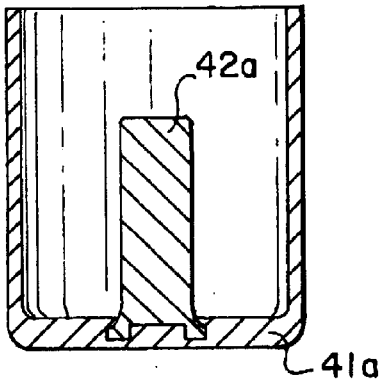
FIG. 4b
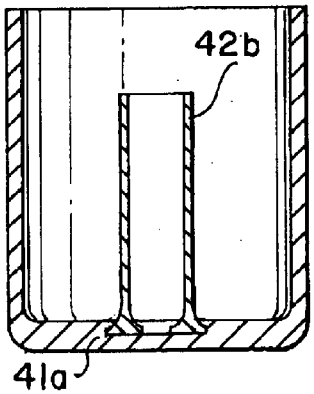

FIG. 4c
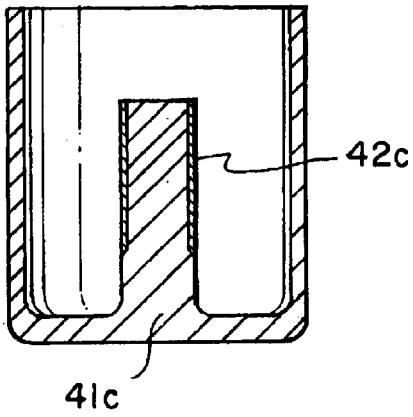
FIG. 4d
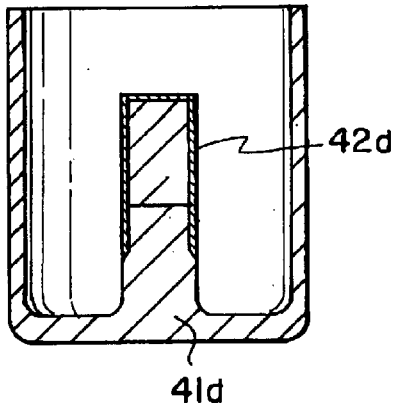
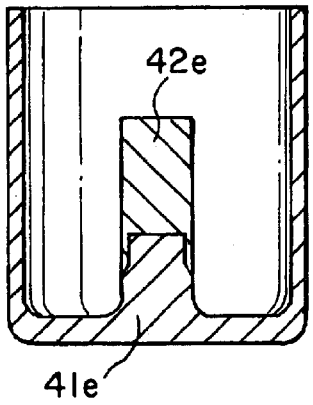
FIG. 4e
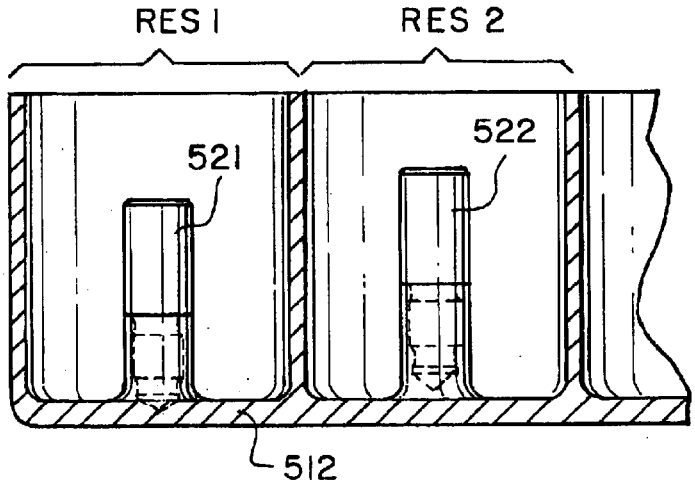
FIG. 5

COAXIAL RESONATOR STRUCTURE AND FILTER

The invention relates to a coaxial resonator structure and a filter structure consisting of coaxial resonators.

Air-insulated coaxial resonators are popular e.g. in radio-frequency filters at base stations of mobile communication networks because of their relatively good electrical characteristics and good manufacturability. A coaxial resonator is most often a quarter-wave resonator where one end of the resonator is short-circuited, i.e. the inner conductor and outer conductor of the resonator are in galvanic contact, and the other end is open. When manufacturing a filter comprising a plurality of resonators, it has to be taken into account that the desired frequency response of the filter may require inner conductors of different lengths. In addition, it may be necessary to compensate for the change in the resonance frequency caused by thermal expansion in the resonator structure.

Figure 1A:
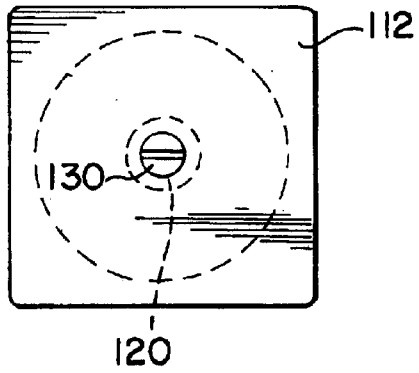
FIG. 1a PRIOR ART

There are several known methods for manufacturing coaxial resonators functioning as filter elements. FIGS. 1 and 1*a* depicts a known structure viewed from the side and from the bottom. Shown in the figures is the resonator's outer conductor 111, inner conductor 120, and the bottom 112. The outer conductor and the bottom are shown in longitudinal section. They constitute a single body 110 having a quadrangular cross section and a cylinder-shaped cavity. The body 110 is made by the process of milling or extruding, for example. The inner conductor is in the said cavity, attached to the bottom 112 of the resonator so that the bottom provides the short circuit between the inner and outer conductor. In this example, the attachment of the inner conductor is realized using a screw 130 extending through the bottom to the inner conductor. The inner conductor may be of the same or different material than the body 110. In the latter case, the temperature compensation in the resonator may be realized through the choice of materials. FIGS. 1 and 1*a* shows only one resonator in a simplified form. A whole filter may have several cavities in one and the same body with electromagnetic couplings between the cavities. On top of the whole structure, there is a conductive cover.

A disadvantage of the structure depicted in FIGS. 1 and 1*a* are the attachment of the inner conductor takes several manufacturing stages and the attachment strength does not meet the strictest requirements. Moreover, the interfaces between the different metals in the structure may cause harmful intermodulation products when using the device.

FIG. 2 shows a longitudinal section of another known structure. The figure shows the resonator's outer conductor 211 and bottom 212. The resonator's inner conductor has now two parts: A lower part 213 nearer the bottom of the resonator and an upper part 220 forming a continuation of the lower part. In this example, the lower part 213 of the inner conductor, bottom 212 and the outer conductor 211 constitute a single body 210. At the bottom end of the upper part of the inner conductor there is a cylindrical hollow 221 the diameter of which equals that of the lower part of the inner conductor. Thus the upper part 220 may be pushed onto the lower part 213 as a cap. The purpose of the upper part of the inner conductor is to provide for the temperature compensation in the resonator. A disadvantage of the structure is that the attachment of the inner conductor requires a separate manufacturing stage. Moreover, in this case, too, the risk of harmful intermodulation is apparent at the attachment interface.

An object of the invention is to reduce the above-mentioned disadvantages associated with the prior art. The method according to the invention is characterized by that which is specified in the independent claim 1. The structure according to the invention is characterized by that which is specified in the independent claims 2 and 9. Some preferred embodiments of the invention are specified in the other claims.

The basic idea of the invention is as follows: a resonator body is manufactured by means of extrusion. In the pushing part of the extrusion machine a recess is made which is shaped like a portion of the surface of the additional object to be attached to the body. The additional object, such as a portion of an inner conductor, is inserted prior to the extrusion in the said recess so that the said portion of the surface of the additional object is positioned tightly against the surface of the recess and the rest of the surface of the additional object remains free. In the extrusion stage, the pushing part with the additional object is pressed against the bloom of body whereby the material of the bloom is pressed tight against the free surface of the additional object. When the pushing part is retracted the additional object remains attached to the body thus formed.

An advantage of the invention is that in conjunction with the manufacturing of the body part of the structure being manufactured, parts may be added to the body without separate manufacturing steps. This means savings in the manufacturing costs. Another advantage of the invention is that the bond according to the invention between the additional part and body part is stronger and more uniform than similar prior-art bonds. This means higher reliability of the structure and less intermodulation at the attachment interface. A further advantage of the invention is that in a filter manufactured according to the invention the inner conductors of the different resonators may be manufactured in different lengths, if necessary, by using recesses of different lengths in the pushing parts of the extrusion machine. The additional parts to be attached to the inner conductors may then be identical, which is advantageous from the standpoint of manufacture.

The invention is described in more detail in the following. Reference is made to the accompanying drawings in which FIGS. 1 and 1*a* show an example of a resonator according to the prior art, FIG. 2 shows another example of a resonator according to the prior art, FIGS. 3*a*, 3*a*–1, 3*a*–2, 3*b*, 3*c*, 3*d*, 3*d*,–1 and 3*d*–2 depict the method according to the invention and an example of a resonator manufactured according to the invention, FIG. 4 shows more examples of a resonator manufactured according to the invention, and FIG. 5 shows an example of a filter structure according to the invention.

FIGS. 1 and 2 were already discussed in conjunction with the description of the prior art.

Figure 3A:
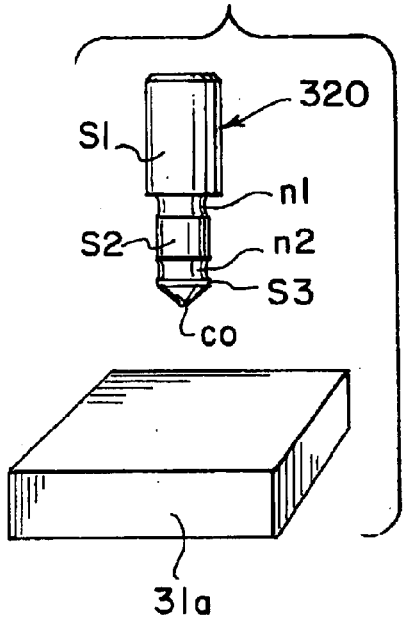
Figures 1, 3A:
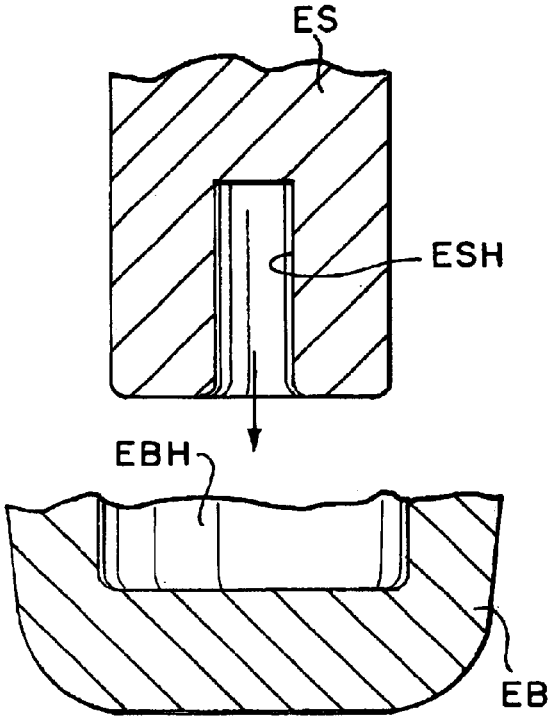
Figures 2, 3A:
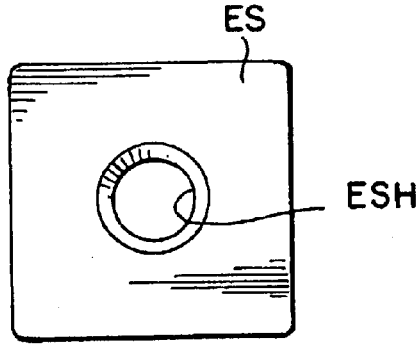

FIG. 3*a* depicts the initial situation of the manufacturing method according to the invention. Shown in the figure is a bloom 31*a* of a resonator body, an additional object 320 to be attached to the body structure, an extrusion base EB serving as a mold, and a pushing part ES of an extrusion machine. The additional object 320 is drawn vertical. In this example, it comprises on one and the same axis a cylindrical upper part s1 and a lower part having a first neck section n1, a second cylinder section s1, a second neck section n2, a third cylinder section s3 and a cone section co. The second and third cylinder sections are rounded at the corners. The diameter of the upper part is greater than the diameter of the lower part at any point. The shape of the bloom 31*a* is a rectangular prism. The extrusion base EB is drawn in FIG. 3*a*–1 in longitudinal section and the upper part cut out. It has in the center a recess EBH that corresponds to the outer dimensions of the object to be manufactured. The pushing part ES of the extrusion machine is depicted both in longitudinal section and viewed from below. The dimensions of the cross section of the pushing part correspond to the inner dimensions of the cross section of the body of the object to be manufactured. The pushing part has a recess ESH according to the invention. The cylindrical recess ESH starts from the lower surface of the pushing part and its diameter is substantially the same as the diameter of the upper part of the additional object.

Figure 3B:
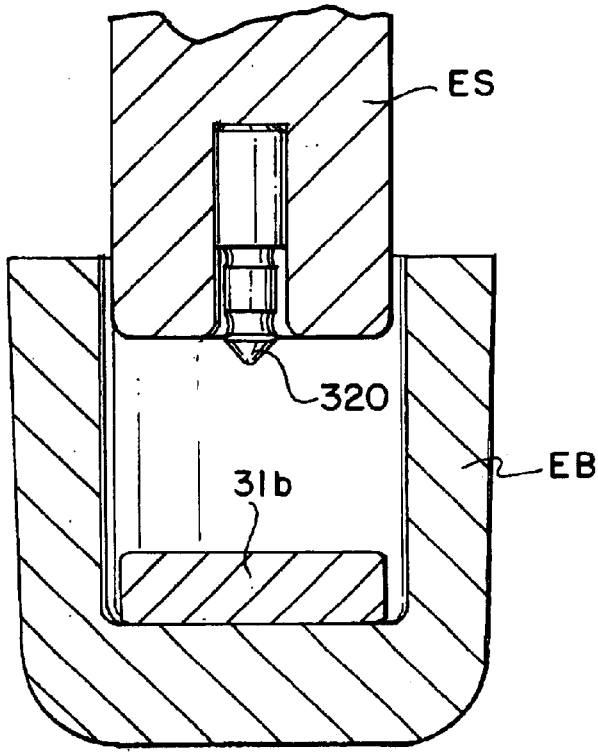

In FIG. 3*b* the bloom 31*b* is placed on the extrusion base EB. An additional object 320 is placed in the recess of the pushing part ES of the extrusion machine. The diameters of the upper part of the additional object and the recess of the pushing part correspond to each other so that the additional object, when its upper part is suitably lubricated, fits tightly into the recess. In this example the length of the recess of the pushing part is such that the conic lowest section of the additional object 320 remains below the lower surface of the pushing part. An empty space is left around the lower part of the additional object.

FIG. 3*c* depicts the extrusion stage. The pushing part ES is pressed at a force F downward against the bloom. The pressure forces the material 31*c* of the bloom to spread into free spaces, which include the relatively narrow space between the walls of the extrusion base EB and pushing part ES and the space around the lower part of the additional object in the recess of the pushing part. In the situation of FIG. 3*c* the latter space has been a bit over half filled. As the downward movement of the pushing part ES ceases, the body material 31*c* has totally filled the space around the lower part of the additional object and risen between the walls into the designated height. After that, the pushing part ES is pulled back up. The additional object 320 remains attached to the body part thus formed. The bond between the body part and the additional object achieved in the manner described is strong because the metallic extrusion material tightly fills up the space around the lower part of the additional object. The design of the lower part of the additional object according to this example adds to the strength of the bond: The said two neck sections n1 and n2 having cylinder surfaces constricted at the middle provide excellent attachment points.

FIG. 3*d-1* shows a longitudinal section and FIG. 3*d*–2 a top view of a resonator structure removed from the extrusion base. The cross section of the outer conductor 311 of the resonator structure is quadrangular in accordance with the design of the extrusion base and pushing part of the extrusion machine. A homogeneous body part 310 comprises the outer conductor 311, bottom 312 and conductive material 313 around the lower part of the additional object 320. The inner conductor of the resonator comprises the said conductive material 313 and additional object 320 excluding the cone section. The cone section remains within the bottom 312. FIGS. 3*d*–1 and 3*d*–2 show a single resonator (without a cover) produced at this stage. Using the method described it is possible to manufacture at one time a whole filter body with attached objects by means of an extrusion machine with several pushing parts. The recesses in the pushing parts may have different lengths. Using a recess in which the additional object can be inserted in its totality, the additional object in the finished product will be positioned higher from the bottom of the structure than in FIG. 3*d*–1. Thus in filters with several resonators the resonators may have inner conductors of different lengths, if necessary, even when the additional objects are identical. FIG. 5 shows an example of such a structure, where in accordance with the above the inner conductor of a resonator RES1 in a filter is shorter than the inner conductor of another resonator RES2.

FIG. 4 shows in longitudinal sections further examples of resonators manufactured according to the invention. In the sub-figure (a) the additional object 42*a* is a cylindrical object the lower part of which spreads into a flange-like base. In the extrusion stage the additional object fills the recess in the pushing part of the extrusion machine in its entirety. The base part of the additional object remains outside the recess so that it lies inside the bottom of the resonator body 41*a* after the extrusion has been completed. The inner conductor of the resonator comprises the additional object 42*a* excluding the part that remains inside the resonator bottom.

In sub-figure 4(*b*) the additional object is an object shaped like a cylinder mantle, in the lower part of which the cylinder walls spread into a flange-like base. In the extrusion stage the additional object 42*b* fills the recess in the pushing part of the extrusion machine in its entirety but the recess itself is now shaped like a cylinder mantle. The base part of the additional object remains outside the recess so that it lies inside the bottom of the resonator body 41*b* after the extrusion has been completed. The inner conductor of the resonator comprises the additional object 42*b* excluding the part that remains inside the resonator bottom.

In sub-figure 4(*c*) the additional object 42*c* is a thin-walled object shaped like a cylinder mantle. In the extrusion stage the additional object is in the pushing part's recess shaped like an open cylinder so that the additional object does not reach the edge of the recess. Extrusion thus produces in the body part 41*c* a cylindrical inner conductor around the upper end of which the additional object is attached.

In sub-figure 4(*d*) the additional object 42*d* is a relatively thin-walled object comprising a cylinder mantle and one end. In the extrusion stage the additional object is positioned in the pushing part's recess, which is shaped like an open cylinder, so that its closed end is in the bottom of the recess and the open end does not reach the edge of the recess. The recess in the pushing part, additional object and the bloom of the resonator body are dimensioned such that in the extrusion, the material of the bloom extends inside the additional object but fills it only partly. Thus is produced a resonator inner conductor comprising a cylindrical part in the body 41*d* and additional object 42*d* around its upper end. In accordance with the above, the body extends only partly inside the additional object, so the upper end of the inner conductor is hollow.

In sub-figure 4(*e*) the additional object 42*e* is a cylindrical object having at one end a cylindrical recess the diameter of which is nearly the same as that of the additional object. In the extrusion stage the additional object is positioned in the recess of the pushing part of the extrusion machine, which recess is shaped like an open cylinder, so that its solid end is in the bottom of the recess of the pushing part and the open end does not reach the edge of the recess. In the extrusion, the material of the bloom fills entirely the recess of the open end of the additional object. Thus is produced a resonator inner conductor the lower part of which comprises a cylindrical part in the body 41*e* and the upper part of which comprises the additional object 42*e*. In accordance with the above, the additional object is compressed around the upper end of the lower part of the inner conductor.

In all versions of the resonator or filter according to the invention, the additional objects attached to the body are primarily used for temperature compensation in the resonator. The body part is advantageously aluminum and the additional objects may be copper or steel, for example.

Above it was described the method according to the invention and some structures according to it. The invention is not limited solely to those. The shapes of the objects belonging to the structure may understandably vary a great deal. For example, the inner conductors of the resonators may be rectangular instead of circular. The inventional idea may be applied in various ways within the scope defined by the independent claims.

I claim:

1. A coaxial resonator structure comprising a body element formed by the process of extrusion and a homogeneous additional object attached thereto, which the homogeneous additional object has a first and a second surface and at least partly constitutes an inner conductor of the resonator, the first surface of the homogeneous additional object bordering the cavity of the resonator, the material of the body element tightly filling the space around the second surface, the homogeneous additional object comprising in sequence, a first cylinder part, a first neck part and a second cylinder part, all said parts having the same axis and the first neck part having a smaller diameter than the second cylinder part, wherein the first surface comprises the cylindrical surface and surface of one end of the first cylinder part and the second surface comprises the balance of the remaining surface of the homogenous additional object.

* * * * *